United States Patent [19]

Jolliffe et al.

[11] Patent Number: 5,054,351

[45] Date of Patent: Oct. 8, 1991

[54] TIRE SPLITTER

[75] Inventors: William C. Jolliffe, London; Steve Mandich, St. Thomas; Kazuhide Obukuro, Willowdale, all of Canada

[73] Assignee: MRP Recycling Technologies Inc., Mississauga, Canada

[21] Appl. No.: 343,653

[22] Filed: Apr. 27, 1989

[51] Int. Cl.[5] ..... B26D 1/02

[52] U.S. Cl. ..... 83/430; 83/431; 83/434; 83/505; 83/563

[58] Field of Search ..... 83/430, 431, 434, 468.6, 83/505, 563; 241/101.4, DIG. 31

[56] References Cited

U.S. PATENT DOCUMENTS

| | | | |
|---|---|---|---|
| 3,693,894 | 9/1972 | Willette | 241/DIG. 31 X |
| 4,090,670 | 5/1978 | Bennett | 241/DIG. 31 X |
| 4,368,656 | 1/1983 | Howerton et al. | 83/431 X |
| 4,405,090 | 9/1983 | Walheim | 241/DIG. 31 X |
| 4,840,316 | 6/1989 | Burclay | 241/DIG. 31 X |

FOREIGN PATENT DOCUMENTS

| | | | |
|---|---|---|---|
| 308703 | 3/1929 | United Kingdom | 83/951 |

*Primary Examiner*—Timothy V. Eley

[57] ABSTRACT

Tire cutting apparatus comprises first and second tire locating members, a tire cutter on one of the tire locating members and a tire drive. The tire locating members are relatively moveable between a loading position, in which the members are separated to allow location of a tire therebetween and a cutting position, in which the first tire locating member engages an inner surface of a tire and the second tire locating member engages an outer surface of a tire. With the tire locating members in the cutting position the cutter cuts through a portion of the tire between the members and the tire drive effects relative movement of the cutter and the tire to produce a circumferential cut in the tire and thus cut the tire into two separate parts. The cut is preferably located around the tread of the tire such that the two separate halves may be stacked, one inside the other.

6 Claims, 2 Drawing Sheets

TIRE SPLITTER

FIELD OF THE INVENTION

This invention relates to tire cutting apparatus, and in particular to apparatus for splitting a tire into halves.

BACKGROUND OF THE INVENTION

As the number of available landfill sites for waste disposal decreases the disposal of scrap tires is becoming an increasing environmental problem In the United States, for example, 240 million tires are discarded annually and in some states dumps of used tires cover many hectares of land. These dumps are unsightly, occupy land that could be put to other uses and provide cover for vermin Also, the fire risk associated with tire dumps is considerable, fires fueled by burning tires being very difficult, if not impossible, to extinguish. A further danger from burning tires is the noxious emissions of sulphur dioxide gas which result, due to the high sulphur content of tires. In addition, the soil beneath such fires becomes "poisoned" and will not support plant growth and may even have to be removed for safe disposal.

In recent years, recycled tires have been put to various uses including the production of domestic door mats and landing mats for aircraft, while others are ground up with asphalt to make rubber pavements. In more recent developments, tires are ground to a powder which is added to other plastics to form a composite useful to make a variety of products such as pipes, drains, fence posts and boards. However, demand for recycled tires has not yet reached a level capable of substantially depleting the stockpile of scrap tires now in existence.

Even if recycling of tires increases, the storage and transport of scrap tires is still inefficient as tires occupy a large volume relative to weight. It would therefore be advantageous to reduce the volume in some way. This can be achieved by splitting tires in half, such that the halves may sit inside one another. However, tire splitting has not presented a practical solution to the problem as operators have had to work with machinery which is inconvenient and often unsafe to use and far too slow to be economically viable.

SUMMARY OF THE INVENTION

According to one aspect of the present invention there is provided tire cutting apparatus comprising first and second tire locating members, tire cutting means on at least one of the tire locating means and tire drive means for movement of a tire relative to the tire cutting means. The tire locating members are relatively moveable between a loading position, in which the members are separated to allow the location of a tire therebetween, and a cutting position, in which a first tire locating member engages an inner surface of a tire and the second tire locating member engages an outer surface of a tire. The tire cutting means is adapted to cut through a portion of the tire between the tire locating members in the cutting position. The tire drive means effects relative movement of the cutting means and the tire to produce a circumferential cut in the tire and thus cut the tire into two separate parts.

Preferably, the circumferential cut is made around the middle of the tread portion of the tire producing two halves which may be stacked one inside the other.

BRIEF DESCRIPTION OF THE DRAWINGS

A prefered embodiment of the present invention will now be described, by way of example, with reference to the accompanying drawings, in which.

DETAILED DESCRIPTION OF PREFERRED EMBODIMENTS

Figure 1:
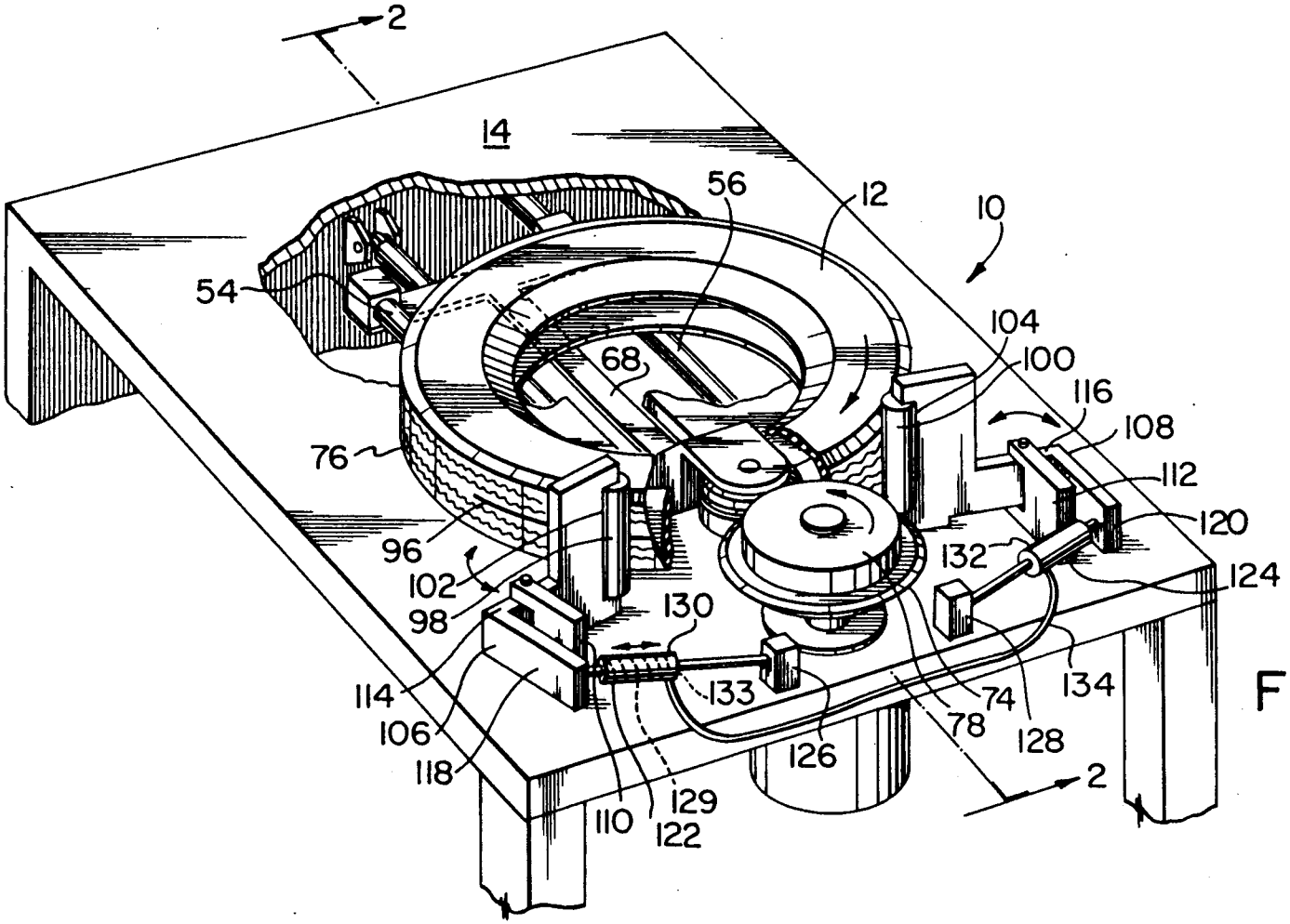
FIG. 1 is a perspective view, partly cut away, of tire cutting apparatus in accordance with a preferred embodiment of the present invention.
Figure 2:
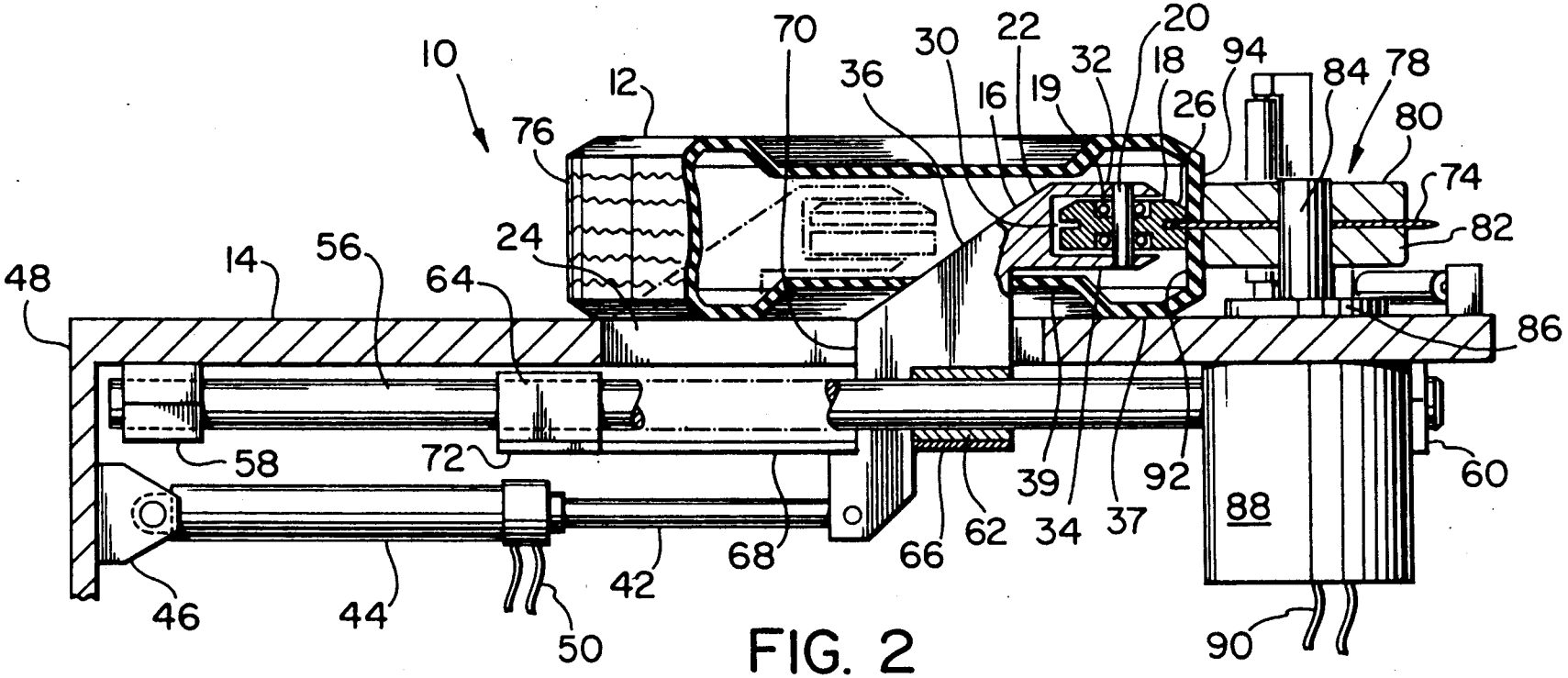
FIG. 2 is a side view of the tire cutting apparatus of FIG. 1, shown partly cut away along line 2–2 of FIG. 1.

The drawings show tire cutting apparatus 10 in the process of splitting a tire 12 mounted on a support table 14 forming part of the apparatus. As will be described, the apparatus 10 permits a tire 12 to be loaded onto the support table 14, then moved to a cutting position (as illustrated in FIGS. 1 and 2) where the tire 12 :s cut or split in two. The split tire 12 is then retracted to the original loading position and the halves removed.

The apparatus 10 includes a first locating member 16 comprising a roller 18 rotatably mounted through a pair of bearings 19 on a vertical pin 20 fixed in a bracket 22 which extends up through a rectangular aperture 24 in the table 14. The roller 18 is substantially disk shaped, having a bevelled upper edge 26 to facilitate mounting of a tire over the roller 18. The roller :s further provided with a circumferential slot 30 for cc-operating with a cutting blade, as will be described.

The roller 18 is mounted in an upper portion of the bracket 22 which is formed as a clevis having upper and lower arms 32, 34, apertured to receive the pin 20. The edges of the arms 32, 34 are bevelled in a similar manner to the roller 18. From the clevis portion, the bracket 22 extends downwardly and rearwardly through the aperture 24, the upper rear surface 36 of the bracket being sloped to facilitate location of a tire over the bracket. The loading position of the bracket 22 is illustrated in ghost outline in FIG. 2, an operator loading a tire by pushing it from the rear of the table 14 up and over the upper rear surface 36 until the tire side wall 37 and tire bead 39 clear the end of the upper arm 32 and the roller 18 and the tire falls over the end of the roller 18 such that the side wall 37 rests on the table 14.

Movement of the bracket 22 between the loading position and the cutting position is achieved by means of a sliding mounting arrangement for the bracket 22 and a hydraulic piston cylinder arrangement. The bracket 22 extends downwardly below the table 14 and is mounted to the end portion of a piston rod 42 of the aforementioned piston cylinder arrangement, the cylinder 44 of which is mounted on a bracket 46 fixed to a rear wall 48 of the table 14. Hydraulic fluid is supplied through hydraulic lines 50 from a suitable pressurized fluid source (not shown). To permit the bracket 22 to slide relative to the table 14 it is mounted on a pair of spaced parallel slide members or rails 54, 56 which extend below the table between mounting brackets 58, 60 at the ends of the table 14. The bracket 22 is mounted to the rails 54, 56 through four pillow blocks 62, 64 (only two shown). The front pair of blocks 62 are welded to the sides of the bracket 22 and a cross plate 66, also welded to the bracket 22, which extends below the bracket and pillow blocks 62. The rear pair of blocks 64 are welded to the sides of a cross shaped member 68 welded to and extending from a vertical rear face 70 of the bracket. A further cross plate 72 is welded to the member 68 and extends below and :s welded to the blocks 64. Thus, movement of the bracket 22 and thus also the roller 18 is achieved by controlling the hydraulic fluid supply to the cylinder 44, permitting the bracket 22 and roller 18 to be moved from the loading position to the cutting position where a cutting blade 74 is forced through the tread portion of the tire 12 into the slot 30 in the roller 18.

The cutting blade 74 is circular and has a 30° cutting edge. The mounting for the blade 74 is provided by a drive wheel 78 forming part of a second tire locating member The drive wheel 78 is formed of two disk shaped parts 80, 82 which are bolted to the blade 74 and one another. One of the parts 80 is keyed to a vertical shaft 84 which extends through a bearing 86 in the table 14 to a hydraulic motor 88 mounted below the table 14. A hydraulic supply for the motor 88 is provided from a fluid source through hydraulic lines 90.

As mentioned above, in the cutting position the blade 74 extends through the tread portion 76 of the tire into the roller groove 30. In this particular example, the blade and groove are positioned 3.5 inches above the table 14 and this has been found to be a convenient average height for splitting the range of automobile tires normally encountered. When in the cutting position, the roller 18 engages an inner tread surface 92 and the drive wheel 78 engages an outer tread surface 94. The drive wheel 78, which may have a knurled surface, is then driven by the motor 88 to rotate, causing the tire 12 and roller 18 to rotate in the opposite direction and thus feeding the tread portion 76 of the tire 12 towards the nip between the drive wheel 78 and the roller 18. At the nip the blade 74 produces a circumferential cut 96 through the tread portion 76 and after a full rotation, the tire is in two separate halves.

When cutting the tire it is advantageous that the tire rotates around a single fixed axis, preferrably on the longitudinal axis of the apparatus 10, which coincides with line 2—2 of FIG. 1. In the illustrated machine, this is achieved through the use of a pair of self adjusting guide rollers 98, 100 which act as third and fourth tire locating members and are located to the sides of the drive wheel 78. The rollers 98, 100 are rotatably mounted in cutout portions 102, 104 in the end of roller brackets 106, 108, themselves pivotally mounted on hinge members 110, 112 extending from the table 14. The rollers 98, 100 extend beyond the ends and sides of the respective brackets 106, 108 such that they engage the tread portion 76 of the tire 12 over a range of bracket postions. The brackets 106, 108 are in the form of bell crank levers, the rollers 98, 100 being located at the end portions of one arm 114, 116 of the respective levers, which end portions are of a height sufficient to accommodate the rollers 98, 100. The pivotal connection between the brackets 106, 108 and the hinge members 110, 112 :s located on the arms 114, 116 to the rear of the roller mounting portion, the other arms 118, 120 of the respective levers extending past the hinge members 110, 112 to respective extendable links 122, 124, :n the form of piston cylinder arrangements. The links 122, 124 extend between the ends of the arms 118, 120 and mounting posts 126, 128 extending from the table surface. Springs 129 (only one shown) are provided in the cylinders 130, 132 which form part of the links 122, 124 and are biassed to extend the links and thus rotate the rollers towards the drive wheel 78. The opposite ends of the cylinders 130, 132 are sealed by respective pistons 133 (only one shown) and are connected by an equalizing hydraulic link 134 which maintains the extension of the links 122, 124 and thus the location of the rollers 98, 100 relative to the cutting blade and drive wheel 74, 78 constant. The rollers 98, 100 thus centre tires of a variety of sizes relative to the blade and drive wheel 74, 78.

In use, a tire cutting operation is commenced with the bracket 22 in the loading position. An operator then pushes a tire up and over the upper rear surface 36 and upper arm 32 of the bracket and roller 18 such that the upper portion of the bracket 22 extends through the centre of the tire. The operator then actuates the piston cylinder arrangement 40 to move the bracket towards the cutting position. As the bracket 22 moves toward the blade 74 and drive wheel 78 it passes between the beads of the tire to engage the inner surface 92 and thus pushes the tire across the table until the outer tread surface engages the drive wheel 78 and the blade 74 extends through the tire. As the tire is being pushed towards the drive wheel 78, the tread portions to either side of the central portion engage the rollers 98, 100 which co-operate to centre the Fire. The operator then activates the motor 88 to rotate the drive wheel 78 and blade 74, thus rotating the tire and roller 18 in the opposite direction and producing a circumferential cut in the tread portion of the tire. After a full rotation of the tire, that is, when the cut extends around the entire tread portion, the tire is cut in two halves. The motor 88 is then stopped and the bracket 22 retracted to the loading position. As the bracket 22 is retracted it pulls the split tire rearwardly into a position where the tire halves can be removed by the operator Another tire is then loaded on the apparatus 10 and the operation repeated.

After the tire halves have been removed from the table they may be stacked, one inside the other, and then baled together. The baling operation tends to flatten the tire halves with the result that the volume occupied by the bailed split scrap tires is substantially reduced when compared to the volume occupied by the corresponding number of "complete" tires. Thus, baled split scrap tires can be more efficiently stored, handled and transported.

The embodiment illustrated is fairly compact and may be located in a building or may even be located on a trailer bed such that the apparatus may be moved from site to site. This would allow the apparatus to be moved between existing tire dumps.

It should be noted that the apparatus illustrated and described above is merely exemplary and various modifications and improvements may be made to the apparatus without departing from the scope of the invention.

If desired, the apparatus may be used in conjunction with a baling machine. When the operation of the apparatus was described above, it was stated that the operator lifted the tire halves from the table for baling. However, it is also possible to provide, for example, a tipping table or tipping arms to move the halves from the table to the baling machine.

In other embodiments of the invention, more than one cutting blade may be provided; the tread portion of a tire is often made of better quality rubber than the sidewalls and two blades positioned to cut through the edges of the tread portion would allow separation of the different grades of rubber for separate recycling.

We claim:

1. Tire cutting apparatus comprising:

first and second tire locating members;

tire cutting means on at least one of the tire locating members; and drive means for movement of a tire relative to the tire cutting means, wherein the tire locating members are relatively moveable between a loading position, in which the members are separated to permit location of a tire therebetween, and a cutting position, in which the first tire locating member engages an inner surface of a tire, the second tire locating member engages an outer surface of a tire and the tire cutting means cuts through a portion of the tire between the members, the drive means effecting relative movement of the tire locating members and the cutting means and the tire to produce a circumferential cut in the tire and thus cut the tire into at least two parts, wherein the first and second tire locating members include respective first and second tire engagement portions rotatably mounted about respective first and second axes to permit movement of a tire between the members inn the cutting position and thus rotation of a tire around a third axis, wherein the cutting means includes a cutting blade mounted to and extending from one of said first and second engagement portions of the locating members, wherein the cutting means further includes a blade receiving slot in the other of said first and second engagement portions of the locating members, wherein when the tire locating members are in the cutting position, the cutting blade extends into the blade receiving slot, wherein the drive means drives one of the first and second engagement portions of the tire locating members to rotate about said respective first or second axis, and further comprising a tire supporting surface wherein the first and second tire locating members extending above the surface, the first tire locating member extending from the surface to permit a tire to be located over the member.

2. Tire cutting apparatus comprising:

first and second tire locating members;

tire cutting means on at least one of the tire locating members; and drive means for movement of a tire relative to the tire cutting means, wherein the tire locating members are relatively moveable between a loading position, in which the members are separated to permit location of a tire therebetween, and a cutting position, in which the first tire locating member engages an inner surface of a tire, the second tire locating member engages an outer surface of a tire and the tire cutting means cuts through a portion of the tire between the members, the drive means effecting relative movement of the tire locating members and the cutting means and the tire to produce a circumferential cut in the tire and thus cut the tire into at least two parts, and further comprising a tire supporting surface wherein the first and second tire locating members extend above the surface, the first tire locating member extending from the surface to permit a tire to be located over the member.

3. The tire cutting apparatus of claim 1 or 2 further comprising tire centering means adapted to engage an exterior surface of a tire and retain the tire substantially on said third axis as the tire is rotated.

4. The tire cutting apparatus of claim 3 wherein the tire centering means comprises third and fourth tire locating members positioned one to each side of said second tire locating member, the third and fourth tire locating members including respective third and fourth tire engagement portions rotatably mounted about respective third and fourth axes.

5. The tire cutting apparatus of claim 4 wherein the third and fourth tire locating members of the tire centering means are equally spaced from the second tire locating member and are moveable to locate tires of different sizes.

6. The tire cutting apparatus of claim 5 wherein the third and fourth tire locating members are pivotally mounted to the rear of the second tire locating member and are linked such that the distance between one of the third and fourth engagement portions and the second tire locating member and the other of the third and fourth engagement portions remains substantially equal.

* * * * *